US006059373A

United States Patent [19]

Wright et al.

[11] Patent Number: 6,059,373

[45] Date of Patent: May 9, 2000

[54] PICK HOLDER EXTRACTION

[75] Inventors: Noel G. Wright, The Reeds; Richard George Holtshausen, Lynnwood Glen, both of South Africa

[73] Assignee: Kennametal Inc., Latrobe, Pa.

[21] Appl. No.: 08/930,495

[22] PCT Filed: Apr. 3, 1996

[86] PCT No.: PCT/US96/04532

§ 371 Date: Dec. 15, 1997

§ 102(e) Date: Dec. 15, 1997

[87] PCT Pub. No.: WO96/31682

PCT Pub. Date: Oct. 10, 1996

[30] Foreign Application Priority Data

Apr. 6, 1995 [ZA] South Africa ..... 95/2855

[51] Int. Cl.[7] ..... E21C 35/18

[52] U.S. Cl. ..... 299/104; 299/106; 299/110

[58] Field of Search ..... 299/106, 110, 299/104; 29/263, 264, 252, 243

[56] References Cited

U.S. PATENT DOCUMENTS 4,586,229 5/1986 Pendola ..... 29/252
5,067,775 11/1991 D'Angelo ..... 299/104
5,119,556 6/1992 Hseu ..... 29/264

FOREIGN PATENT DOCUMENTS 2385890 10/1978 France .
2438739 5/1980 France .
8625406 12/1986 Germany .
2072241 9/1981 United Kingdom .
2151284 7/1985 United Kingdom .
2247705 3/1992 United Kingdom .
2285464 7/1995 United Kingdom .

*Primary Examiner*—Eileen Dunn Lillis
*Assistant Examiner*—John Kreck
*Attorney, Agent, or Firm*—Ladas & Parry

[57] ABSTRACT

A pick holder (110) is frictionally seated via a round cylindrical barrel (112) in a pick box of a continuous miner. A pick is in operation rotationally located in a bore (114). The bore (114), toward a rear thereof, has an internal, inwardly projecting screw thread (30). When the pick has been removed, the pick holder (110) is extracted from the pick box by screwing a screw threaded shank into the screw thread (30), and applying an extracting force via the shank and the interengaged screw threads to the pick holder (110).

12 Claims, 2 Drawing Sheets

PICK HOLDER EXTRACTION

BACKGROUND OF THE INVENTION

THIS INVENTION relates to extracting a pick holder from a pick box in a continuous miner drum; to extraction means for carrying out the method of the invention, to a pick holder, and to an extraction tool.

In one kind of continuous miner, for example a continuous miner manufactured by the firm Voest Alpine, there is provided a plurality of pick boxes arranged in predetermined fashion on a drum of the continuous miner. Each pick box has a substantially blind socket within which a pick holder is replaceably received. A shank of a pick is in turn replaceably received within the pick holder such as to allow rotation of the pick relative to the pick holder in use. Receipt of the pick holder in the pick box is by means of a tight, frictional, press fit. The pick holder is to be removable to allow replacement, reconditioning, and the like.

In known pick holders there is provided an internal circumferential groove to retain a pick in use via a retaining ring on a shank of the pick. One way to remove the pick holder from the pick box (when the pick has been removed), is by dilating a collar on a shank of an extracting tool to locate in said internal circumferential groove and to apply an extraction force on the shank. The force is then transmitted via a shoulder of the internal circumferential groove to extract the pick holder from the pick box.

Although this method is generally used, it has at least two problems. First, the integrity of locating the collar of the extracting tool in the internal circumferential groove is not good. It does happen that the internal collar slips, which may result in a very unsatisfactory and possibly dangerous situation and possible damage to equipment. Second, the collar of the extracting tool is to be dilatable to enable it to engage the internal circumferential groove, thus requiring a composite (more than one part) design which is expensive to manufacture. Such extracting tool becomes worn fairly quickly and has to be reconditioned or replaced after a relatively small number of extracting operations.

An alternative, known, method is to provide an external circumferential groove in a portion of the outer surface of the pick holder which protrudes from the pick box. This method has generally the same disadvantages as the first mentioned known method. In addition, the external circumferential groove is exposed to the working conditions and becomes worn and unusable for locating purposes fairly quickly. Furthermore , the protruding portion or head may shear of f, which renders extraction by means of the external groove impossible.

It is an object of this invention to provide a method, an extracting means, a pick holder and an extraction tool which improve on the prior art and which do not suffer, or at least suffer to a smaller degree, from the problems of the prior art.

SUMMARY OF THE INVENTION

In accordance with a first aspect of this invention, there is provided a method of extracting a pick holder from a pick box of a continuous miner drum, the method including providing an internal rotary fastening formation in a bore of the pick holder, providing a complemental external rotary fastening formation on a shank of an extraction tool, interengaging the complemental rotary fastening formations by relative rotation between the pick holder and the extraction tool and applying an extraction force to the pick holder via the shank and via the engaged rotary fastening formations.

In a preferred method, the rotary fastening formations may be screw threads and interengaging the complemental rotary fastening formations may be by screwing them together. In other methods, mere twisting or pivoting may be required.

The method may include centering the shank of the extraction tool relative to the pick holder when applying the extraction force. Centering may be effected by supporting the shank in the mouth or bore of the pick holder with little clearance. Supporting the shank in the mouth or bore may be via a sleeve received over the shank and fitting into the mouth or bore with little clearance, or by appropriate selection of the diameter of the shank.

The invention extends in accordance with a second aspect to extraction means suitable for use in extracting a pick holder from a pick box of a continuous miner drum, the extraction means including, in combination an internal rotary fastening formation in a bore of the pick holder; and a complemental, external rotary fastening formation on a shank of an extraction tool, the shank being receivable in the bore of the pick holder and the complemental rotary fastening formations being interengagable by relative rotation to allow an extraction force to be applied to the pick holder via the extraction tool and the interengaged rotary fastening formations in use.

In a preferred embodiment, the rotary fastening formations may be in the form of screw threads which are screw threadingly interengagable. In other embodiments, other kinds of rotary fastening formations requiring mere twisting or pivoting (e.g. a bayonet-type connector) may be provided.

The internal screw thread may conveniently be positioned axially remote from a mouth of the pick holder spaced behind an internal circumferential groove provided for anchoring a pick in the pick holder.

The internal screw thread may be of a diameter such that an outer or major diameter of the complemental screw thread on the shank is smaller than the bore of the pick holder.

By way of development, the external screw thread on the shank may have a leading thread in the form of a cleaning or opening thread, tap fashion, to clean up the internal screw thread. Thus, the leading thread may be sharp or knife edged. Then, the external screw thread may have at least one longitudinal groove or passage to pass matter which has been cleared from the internal screw thread.

Advantageously, the extraction means may further comprise a collar or sleeve which is replaceably received around the shank and which is of an outer diameter allowing it to enter the bore of the pick holder with little clearance so as to support the shank in the bore with little clearance.

The invention extends in accordance with a third aspect to a pick holder suitable for receipt in a pick box of a continuous miner, the pick holder including an internal rotary fastening formation in a bore thereof.

The invention extends yet further in accordance with a fourth aspect to an extraction tool suitable for use in extracting a pick holder having an internal rotary fastening formation in a bore thereof from a pick box of a continuous miner, the extraction tool having a shank and, toward one end of the shank, an external rotary fastening formation, and, toward an opposed end of the shank, engagement means for applying an extraction force to the shank.

BRIEF DESCRIPTION OF THE DRAWINGS

The invention is now described by way of example, with reference to the accompanying diagrammatic drawings. In the drawings

DETAILED DESCRIPTION

Figure 1:
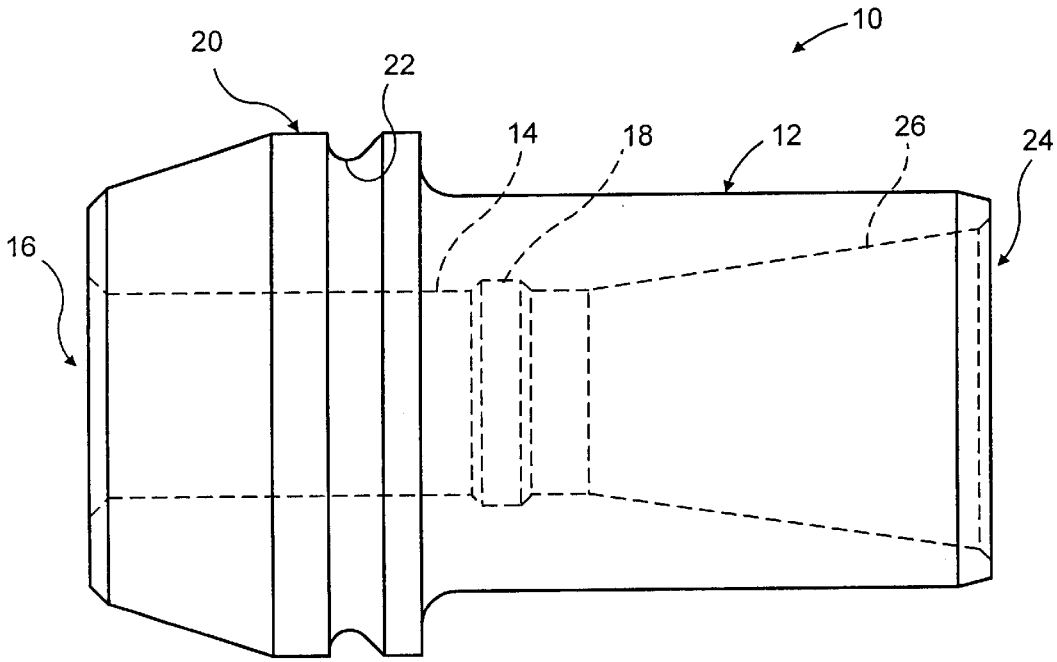
FIG. 1 PRIOR ART
FIG. 1 shows, in side view, a prior art embodiment of a pick holder of the general kind to which this invention relates.

With reference to FIG. 1, a prior art or known pick holder of the general kind to which this invention relates is generally indicated by reference numeral 10. It comprises a round cylindrical outer surface 12 which is machined to a close tolerance to allow the pick holder 10 to be frictionally received, by means of a press fit, within a complemental bore of a pick box.

The pick holder 10 has a concentric inner bore 14 of a size slidingly to pass a shank of a pick. The inner bore 14 is open at a mouth 16 at a front of the pick holder 10.

The bore 14 opens up in a rearward portion of the pick holder 10 in the form of a diverging passage 26 running out in a rear end 24 of the pick holder 10.

Toward a rear of the bore 14, but slightly spaced from the start of the diverging passage 26, there is provided an internal peripheral groove 18 within which an expandable locating ring of the pick is received to locate the pick axially within the pick holder 10 and to allow free rotation of the pick relative to the pick holder 10.

When the pick has been removed from the pick holder 10, the pick holder 10 can be extracted from the pick box by passing a shank of an extraction tool into the inner bore 14, dilating a dilatable collar to seat in the internal peripheral groove 18 and by applying an extraction force on the shank. This method has at least two disadvantages which are severe and which have been described above.

A fore portion of the pick holder 10 projects in use from the pick box. An outer circumferential groove 22 is provided in such protruding portion 20.

An alternative method of extracting the pick holder 10 from the pick box, is to provide a contractible jaw which is contracted to seat in the outer circumferential groove 22. An extraction force can then be applied via the jaw to the pick holder 10 to extract it from the pick box. As described above, this method has the same disadvantages as the method used with the internal peripheral groove 18. In addition, the external extraction method further has the disadvantage that the outer circumferential groove 22 is exposed to working conditions of the pick and thus quickly becomes worn to an extent in which it is unusable for extraction purposes.

Figure 2:
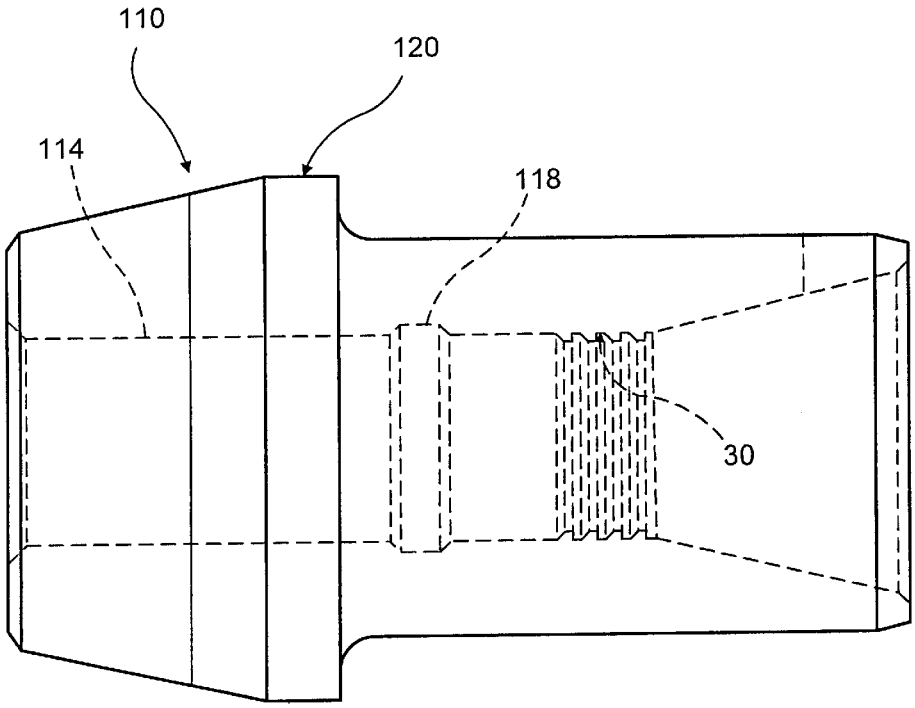
FIG. 2 shows, in a view corresponding to that of FIG. 1, a pick holder in accordance with this invention.

With reference to FIG. 2, a pick holder in accordance with this invention is generally indicated by reference numeral 110. In many respects it is similar to the pick holder 10 of FIG. 1 and similar features and components are not again described. Those features and components are numbered using like reference numerals. Emphasis will herein be placed on the differences of the pick holder 110 over he pick holder 10.

First, the pick holder 110 does not require an outer circumferential groove in its protruding portion 120. It can, however, be provided with such a groove to allow an operator the option of extracting it from a pick box by the known method.

The major difference is that an internal screw thread 30 is provided in the internal bore 114 at a position spaced behind the internal circumferential groove 118. The screw thread 30 is provided such that a major root thereof is not larger than the nominal diameter of the inner bore 114. The screw thread 30 is conveniently of saw-tooth shape.

Figure 3:
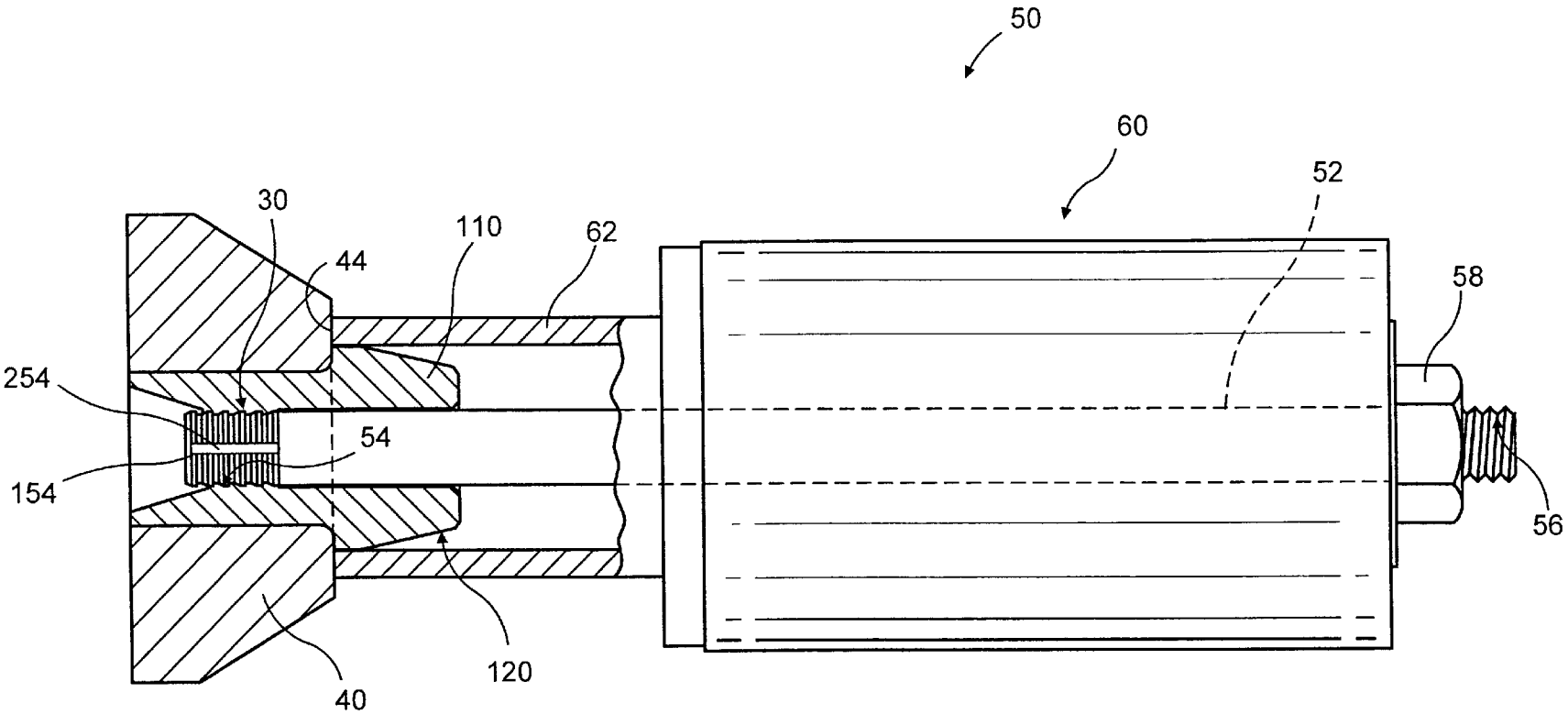
FIG. 3 shows, schematically, in part sectional side view, extraction of a pick holder from a pick box in accordance with this invention.

Reference is also made to FIG. 3 where an extraction device is generally indicated by reference numeral 50 in operative condition to extract the pick holder 110 from a pick box 40. It is emphasised that, especially FIG. 3, is schematic to illustrate the principle of the invention.

The extraction device 50 has a centre shank 52 having, at one end, a screw thread 54 complemental to the screw thread 30 of the pick holder 110. Furthermore, the diameter of the shank 52 is selected such that it is snugly, slidingly received in the inner bore 114 of the pick holder 110. As described above, the screw thread 30 projects inwardly thus allowing the screw thread 54 to interengage the screw thread 30 and yet be able to enter the inner bore 114. If desired, one thread of the screw thread 54, advantageously the screw thread which will be a leading screw thread in use, may be a cleaning screw thread 154, tap fashion. Screw thread 54 may have a longitudinal groove 254.

At an end of the shank remote from the screw thread 54, it has a screw thread 56 for a locating or anchoring nut 58.

The extraction device 50 further comprises an annular hydraulic jack means 60 and a bush 62 arranged in series around the shank 52. An outer end of the hydraulic jacking means 60 abuts the nut 58 and an opposed end of the bush 62 abuts a nose 44 of the pick box 40. The bush 62 fits snugly around the protruding portion 120 of the pick holder 110.

Extension of the hydraulic means 60 imparts an extraction force on the shank 52 which is transmitted via the interengaging screw threads 54, 30 to the pick holder 110 to extract it from the pick box 40.

The screw threads 30, 54 are conveniently of a relative course kind and may be of rounded or saw-tooth cross-section.

It will be appreciated by a person skilled in the art that the method and extraction means in accordance with the invention are of high integrity which would not slip or otherwise fail unless under most extreme circumstances. Furthermore, the extraction means is of simple construction thus allowing it to be manufactured at relatively low expense and with a high degree of integrity.

The Applicant is aware that persons skilled in the art of the invention have been aware for a long time that extraction of pick holders or the kind described from pick boxes is problematic, dangerous, time consuming and requires relatively expensive extraction equipment. The Applicant believes that this invention, which appears to be surprisingly simple, nevertheless provides a very elegant and effective solution to a problem which has been widely known for a long time and which, until this invention has been made, has escaped a good solution.

We claim:

1. A method of extracting a pick holder from a pick box of a continuous miner drum, the method including providing an internal rotary fastening formation in a bore of the pick holder, providing a complemental external rotary fastening formation on a shank of an extraction tool, interengaging the complemental rotary fastening formations by relative rotation between the pick holder and the extraction tool and applying an extraction force to the pick holder via the shank and via the engaged rotary fastening formations.

2. A method as claimed in claim 1 in which the rotary fastening formations are screw threads and in which interengaging the complemental rotary fastening formations is by screwing them together.

3. A method as claimed in claim 1 which includes centering the shank of the extraction tool relative to the pick holder when applying the extraction force.

4. A method as claimed in claim 3 in which the bore of said pick holder opens to a mouth at the front of the pick holder and centering is effected by supporting the shank in the mouth or bore of the pick holder with little clearance.

5. A method as claimed in claim 4 in which supporting the shank in the mouth or bore is via a sleeve received over the shank and fitting into the mouth or bore with little clearance.

6. Extraction means suitable for use in extracting a pick holder from a pick box of a continuous miner drum, the extraction means including, in combination an internal rotary fastening formation in a bore of the pick holder; and a complemental, external rotary fastening formation on a shank of an extraction tool, the shank being receivable in the bore of the pick holder and the complemental rotary fastening formations being interengagable by relative rotation to allow an extraction force to be applied to the pick holder via the extraction tool and the interengaged rotary fastening formations in use.

7. Extraction means as claimed in claim 6 in which said internal rotary fastening formation is an internal screw thread and said external rotary fastening is an external screw thread, and said screw threads are screw threadingly interengagable.

8. Extraction means as claimed in claim 7 in which the internal screw thread is positioned axially spaced behind an internal circumferential groove remote from a mouth of the pick holder.

9. Extraction means as claimed in claim 8 in which the internal screw thread is of a diameter such that an outer or major diameter of the complemental screw thread on the shank is smaller than the bore of the pick holder.

10. Extraction means as claimed in claim 7 in which the external screw thread on the shank has a leading thread in the form of a cleaning or opening thread, tap fashion, to clean up the internal screw thread.

11. Extraction means as claimed in claim 10 in which the external screw thread has at least one longitudinal groove or passage to pass matter which has been cleared from the internal screw thread.

12. Extraction means as claimed in claim 6 which further comprises a collar or sleeve which is replaceably received around the shank and which is of an outer diameter allowing it to enter the bore of the pick holder with little clearance so as to support the shank in the bore with little clearance.

* * * * *